United States Patent [19]

Vetter

[11] Patent Number: 5,077,776

[45] Date of Patent: Dec. 31, 1991

[54] ROTARY ANODE X-RAY TUBE WITH LUBRICANT

[75] Inventor: Axel Vetter, Hamburg, Fed. Rep. of Germany

[73] Assignee: U.S. Philips Corporation, New York, N.Y.

[21] Appl. No.: 664,421

[22] Filed: Mar. 4, 1991

Related U.S. Application Data

[63] Continuation of Ser. No. 447,986, Dec. 8, 1989, abandoned.

[30] Foreign Application Priority Data

Dec. 14, 1988 [DE] Fed. Rep. of Germany ..... 3842034

[51] Int. Cl.[5] ..... H01J 35/10

[52] U.S. Cl. ..... 378/133; 378/119; 384/368

[58] Field of Search ..... 378/132, 133, 125, 183, 378/119, 135, 131; 384/132, 368, 292

[56] References Cited

U.S. PATENT DOCUMENTS

| | | | |
|---|---|---|---|
| 4,210,371 | 7/1980 | Gerkema et al. | 378/183 |
| 4,614,445 | 9/1986 | Gerkema et al. | 384/368 |
| 4,641,332 | 2/1987 | Gerkema | 378/133 |
| 4,856,039 | 8/1989 | Roelandse et al. | 378/133 |

FOREIGN PATENT DOCUMENTS 2010985 6/1978 United Kingdom .

*Primary Examiner*—Edward P. Westin
*Assistant Examiner*—Kim-Kwok Chu
*Attorney, Agent, or Firm*—Robert J. Kraus

[57] ABSTRACT

The invention relates to a rotary anode X-ray tube with a sliding bearing, in particular a spiral flute bearing. In the case of such an X-ray tube, the passing of lubricant into the vacuum space of the X-ray tube, filled with a strong electric field in the operating state, is prevented by the surfaces, over which the lubricant reaches the space mentioned, being provided with a coating which can be wetted by the lubricant and forms an alloy with the latter.

7 Claims, 1 Drawing Sheet

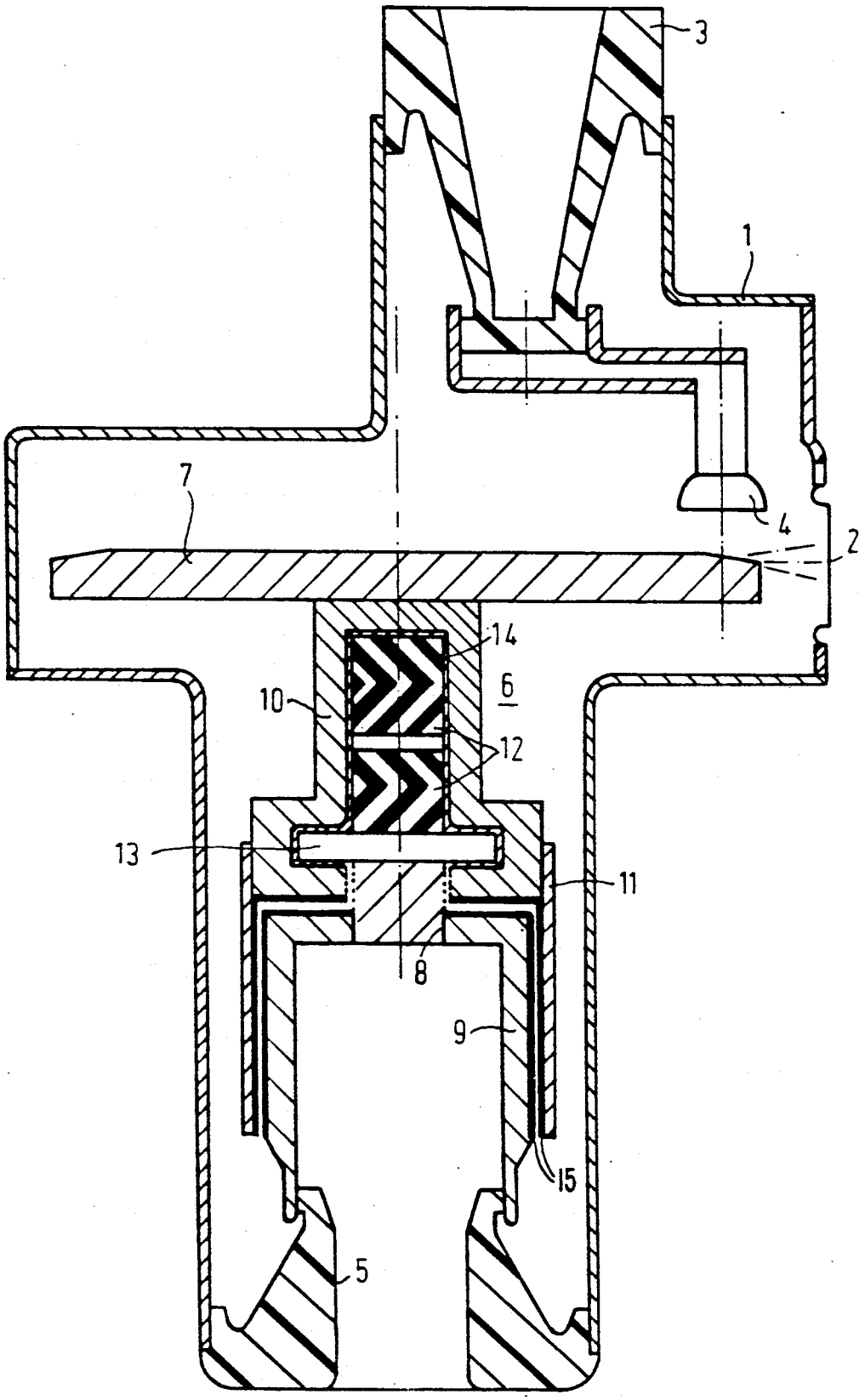
3
1
7
4
2
14
6
10
12
13
11
8
9
15
5

ROTARY ANODE X-RAY TUBE WITH LUBRICANT

This is a continuation of application Ser. No. 447,986, filed on Dec. 8, 1989, now abandoned.

BACKGROUND OF THE INVENTION

The invention relates to a rotary anode X-ray tube with at least one sliding bearing, which is filled with a liquid lubricant. Such an X-ray tube is known, inter alia, from European Laid Open Patent Application 141,476. The sliding bearings for the bearing of the rotary anode are in this case formed by so-called spiral flute bearings, which have a narrow gap and a pattern of flutes on one of their bearing surfaces. In the bearing gap, which is bounded on the one side by a smooth bearing surface and on the other side by the surface with the flute pattern, there is the lubricant. The flutes are formed in such a way that the lubricant remains in the bearing during the operation of the rotary anode X-ray tube with a predetermined direction of rotation. Adjoining the spiral flute bearing is a surface which is prepared in such a way that it cannot be wetted by the lubricant, for example by a titanium-oxide or silicon-oxide carbide layer.

In the case of such rotary anode X-ray tubes, it may happen, in particular during transit, that drops of lubricant escape from the bearing and get into the part of the vacuum space of the X-ray tube which is exposed to a strong electric field in operation of the tube. These drops of lubricant impair the high-voltage strength of the X-ray tube and can lead to its destruction.

SUMMARY OF THE INVENTION

It is an object of the present invention to design a rotary anode X-ray tube of the type mentioned at the beginning in such a way that the operation of the x-ray tube cannot be impaired by drops of lubricant escaping from the sliding bearing.

According to the invention, this object is achieved by the surfaces in the opening area via which the spiral flute bearing is in communication with the remaining vacuum space of the X-ray tube consisting of a material which can be wetted by the lubricant and consequently can form mixed phases or alloys.

In the case of the invention, the surface of the opening area through which the lubricant has to pass in order to reach the remaining vacuum space, filled with an electric field in the operating state, from the bearing containing a material which can be wetted by the lubricant and consequently forms mixed phases. Thus, in this case the lubricant cannot escape into the space filled with an electric field in the operating state because it adheres to the surface in the opening area and diffuses into the said surface. Wherever possible, the area up to the vacuum space under high voltage should be designed as a labyrinth.

The lubricant and the surface material in the opening area must be matched to each other. As is known, gallium alloys are suitable as lubricants of sliding bearings. However, with many metals these alloys often only form a mixed phase, i.e a new alloy, if the surfaces of the metals passivated by oxides or carbides are destroyed. Therefore, only the metals which do not form such boundary layers (precious metals) or with which these boundary layers are destroyed by the pumping and baking processes involved in the conditioning of X-ray tubes, for example copper, are suitable. A preferred further development therefore envisages that the lubricant consists of a gallium alloy and the surface in the opening area consists of a precious metal. A drop of lubricant of a gallium alloy spreads out on a metal surface which is, for example, goldplated, on account of the wetting and alloy formation, and diffuses into the base material, in particular at elevated temperatures, but also even at room temperature.

If the surfaces envisaged by the invention, which can be wetted with lubricant and consequently form mixed phases, were to be directly adjacent to the sliding bearing surfaces, the lubricant would pass relatively readily out of the sliding bearing onto these surfaces, which would have an undesired loss of lubricant as a consequence. In a further development of the invention, this can be reduced by the surfaces directly adjacent to the spiral flute bearing consisting of a material which cannot be wetted by the lubricant and by these surfaces being adjoined by surfaces which can be wetted by lubricant and consequently form mixed phases. In the case of a gallium alloy as lubricant, non-wettable surfaces can be produced by, for example, titanium-oxide carbide coatings or silicon-oxide carbide coatings.

BRIEF DESCRIPTION OF THE DRAWINGS

The invention is explained in more detail below with reference to the drawing, which shows a rotary anode X-ray tube according to the invention in a cross-section including the axis of rotation.

DESCRIPTION OF THE PREFERRED EMBODIMENT

The X-ray tube represented in the drawing has a metal envelope 1, in which a beam exit window 2, for example of beryllium, is provided, and which bears the cathode 4 on a first insulator 3 and the rotary anode 6 on a second insulator 5. The rotary anode 6 comprises an anode plate 7, from which the x-radiation emanates in operation, and which is connected to the second insulator 5 via a bearing. The fixed part of the bearing comprises a spindle 8 of a molybdenum alloy, which is connected to the insulator 5 via a support element 9 of an iron-nickel-cobalt alloy (Vacon). The positive high voltage for the rotary anode is fed via the part 9. The rotating part 10 of the bearing comprises a bearing bush 10, which is concentric to the spindle 8, likewise consists of a molybdenum alloy and is adapted to the dimensions of the spindle 8, so that there remains between the spindle 8 and the bush 10 only a narrow gap, which is significantly narrower than is represented in the drawing and is, for example, 20$\mu$ thick.

The bearing is a sliding bearing in the form of a spiral flute bearing. For this purpose, the spindle 8 is provided with two herringbone flute patterns 12, which are mutually offset in axial direction and act as radial bearings. The spindle 8 also includes a cylindrical thickening 13, the end faces of which are likewise provided with a flute pattern (not shown in any more detail), and therefore act as spiral flute bearings for the axial bearing of the anode. Due to the thickening 13, the bush 10 cannot be in one part—as represented in the drawing but must consist of at least two parts which are connected to each other in such a way that the lubricant cannot escape through the connecting areas. In the intermediate space between the spindle 8 and the bush 10 there is a gallium alloy (GaInSn), as lubricant 14. This lubricant is liquid at room temperature and wets the surfaces of the spindle 8 and of the bush 10, without going into alloys.

In practice, it is unavoidable that lubricant escapes from the bearing, in particular due to shocklike mechanical stresses. If the lubricant gets into the part of the vacuum space of the X-ray tube in which there is a strong electric field in the operating state, the X-ray tube may be destroyed. Since the bearing is hermetically sealed off from the anode plate, the lubricant can only get into this space between the lower part of the spindle 8 and the bush 10 and between the outer surface of the support element 9 and the surface of the rotor 11, there being a high probability of it getting on to the insulator 5 and inducing high-voltage punctures there.

This is prevented by the surfaces being goldplated in the opening area through which the lubricant escaping from the bearing gets into the remaining vacuum space of-the X-ray tube. This is indicated by thick solid lines 15 on the outer surface of the support element 9 and the surface facing it of the bush 10 and the inner surface of the rotor 11. The gallium alloy forming the lubricant wets gold-plated metal surfaces and consequently already forms a new alloy at room temperature. A lubricant drop thus adheres to these metal surfaces in the field-free area and cannot escape into the vacuum space of the X-ray tube filled with the field. The surfaces in the opening area are advantageously arranged in the manner of a labyrinth.

As emerges from the above, the surface in the opening area must be given such a finish that it can readily be wetted by the lubricant and form an alloy with the latter. For gallium as lubricant, among the metals for this are precious metals—inter alia, gold—but also others. However, the surface of the metals other than precious metals is usually passivated by oxides or carbides, so that a drop of gallium does not adhere to it. In the case of some of these metals (for example copper), these layers are substantially destroyed by the pumping and baking processes which an X-ray tube undergoes before first putting into operation. Wetting, and consequently the capturing of a lubricant drop, also occurs on a copper surface which is about 100° C. hot. Thus, the gold-plating of the inside surface of the copper rotor 11 could be dispensed with, provided that the copper surface is not contaminated and is kept at least 100° C.

Gallium which escapes from the bearing and adheres to the gold-plated surface of the support element 9 also diffuses during the course of time into the support element 9, which consists of an iron-nickel-cobalt alloy, the thermal coefficient of expansion of which is adapted to that of the insulator 5. This support element thus also gradually takes up the escaping lubricant, which has in particular the advantage that the expensive gold layer can be very thin. If this support element were to come into contact with the lubricant without gold-plating, the oxide or carbide boundary layers on the surface would prevent an adhesion of the lubricant. The gold layer must therefore be anchored on the support element in such a way that the disruptive boundary layers are destroyed, for example by known galvanic preparation methods.

If the surfaces which can be wetted by the lubricant—and these also include the surfaces of the bearing bush 10 and of the spindle 8 in the lower area—which will reach right up to the sliding bearings, the lubricant could also wet these surfaces relatively readily and would thereby deprive the bearing. In order to avoid this, the surfaces in the lower area of the spindle 8 and of the bearing 10 are provided with a layer which prevents a wetting by the lubricant, as indicated by the dotted lines. A suitable layer consists, for example, of titanium-oxide carbide. It prevents lubricant running out of the bearing in normal operation. Only when the lubricant has nevertheless overcome this non-wettable area with capillary action, due to strong mechanical shocks or the like, does it get onto the layer according to the invention,. to which it adheres.

What is claimed is:

1. A rotary anode x-ray tube including an envelope for forming a vacuum space containing a fixed part which is affixed to the envelope and a rotary part which is rotatably attached to the fixed part, said fixed and rotary parts comprising:

a. respective bearing portions having opposing surfaces defining therebetween a gap containing a lubricant;

b. respective spaced-apart portions through which the gap communicates with the vacuum space, said passage-defining surfaces, at a region which is separated from the gap-defining surfaces, comprising a wettable material to which lubricant escaping from the gap readily adheres.

2. A rotary anode x-ray tube as in claim 1 where at least one of the opposing passage-defining surfaces, at the region which is separated from the gap-defining surfaces, comprises a layer of the wettable material.

3. A rotary anode x-ray tube as in claim 1 or 2 where the lubricant consists essentially of a gallium alloy and where the wettable material consists essentially of a precious metal.

4. A rotary anode x-ray tube as in claim 3 where the wettable material consists essentially of gold.

5. A rotary anode x-ray tube as in claim 2 where the layer is supported on a base material into which the lubricant can diffuse through the layer.

6. A rotary anode x-ray tube as in claim 1 or 2 where the passage-defining surfaces, at a region adjacent the gap-defining surfaces, comprise a non-wettable material to which the lubricant does not readily adhere.

7. A rotary anode x-ray tube as in claim 6 where the lubricant consists essentially of a gallium alloy and where the passage-defining surfaces, at the region adjacent the gap-defining surfaces, comprise respective coatings consisting essentially of titanium oxide carbide.

* * * * *